United States Patent [19]

Vinson

[11] Patent Number: 5,016,399

[45] Date of Patent: May 21, 1991

[54] PLANETARY LAP

[76] Inventor: Paul Vinson, P.O. Box 5264, Valdosta, Ga. 31603

[21] Appl. No.: 506,295

[22] Filed: Apr. 9, 1990

[51] Int. Cl.[5] ..... B24B 7/00

[52] U.S. Cl. ..... 51/118; 51/119; 51/131.3; 51/126; 51/132

[58] Field of Search ..... 51/111 R, 117, 118, 51/119, 129, 131.3, 131.4, 132, 126

[56] References Cited

U.S. PATENT DOCUMENTS

| | | | |
|---|---|---|---|
| 859,343 | 7/1907 | Shirley | 51/118 |
| 1,476,863 | 12/1923 | Weaver | 51/118 |
| 1,634,745 | 7/1927 | Fraser . | |
| 2,618,911 | 11/1952 | Indge | 51/118 |
| 3,000,148 | 9/1961 | Bovensiepen | 51/111 R |
| 3,032,937 | 5/1962 | Day et al. | 51/129 |
| 3,461,617 | 8/1969 | Wright | 51/131.4 |
| 3,541,734 | 11/1970 | Clar | 51/118 |
| 3,691,694 | 9/1972 | Goetz | 51/118 |
| 4,205,489 | 6/1980 | Orlov et al. | 51/118 |
| 4,593,495 | 6/1986 | Kawakami et al. | 51/118 |

FOREIGN PATENT DOCUMENTS

| | | | |
|---|---|---|---|
| 1353975 | 1/1964 | France | 51/118 |

*Primary Examiner*—Robert A. Rose
*Attorney, Agent, or Firm*—Warren F. B. Lindsley

[57] ABSTRACT

A lapping machine for abrading the surfaces of at least one workpiece employing a pair of lap plates in axial alignment with each other and having a carrier mounted therebetween for mounting workpieces therein wherein one of the lap plates is controllable for free wheeling and/or locked operation relative to the other lap plate and is rotatable relative to the other lap plate through 180 degrees for exposing the carrier and the work surfaces of each lap plate.

5 Claims, 4 Drawing Sheets

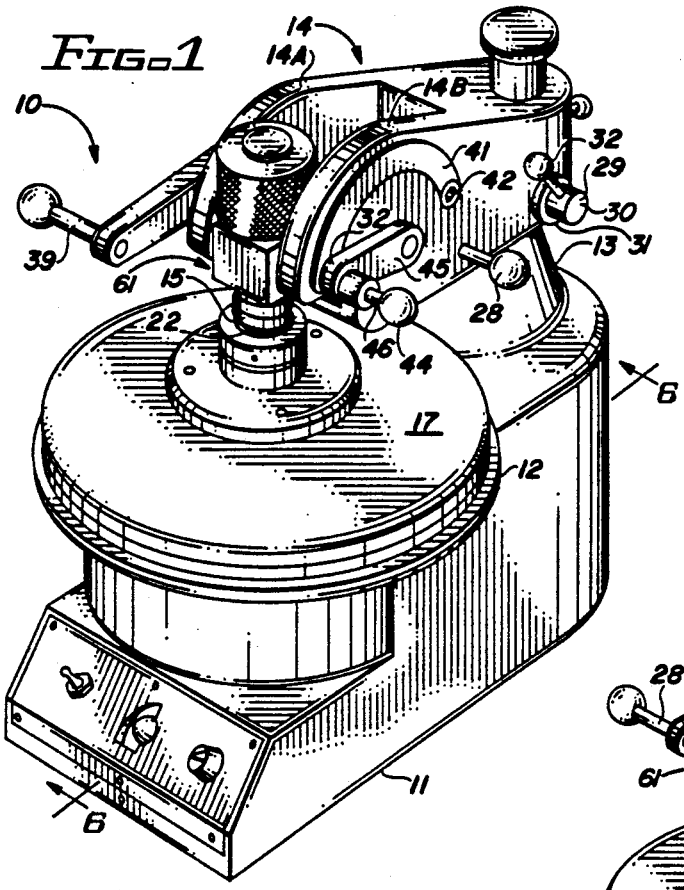
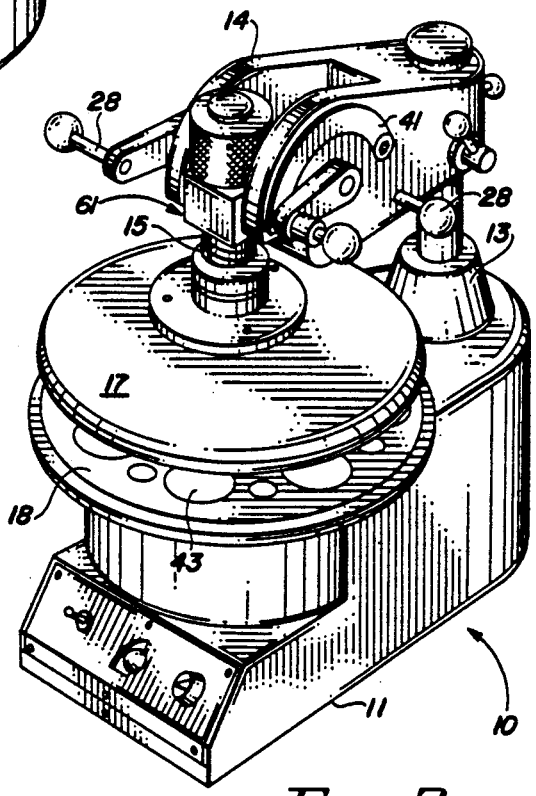
FIG. 2
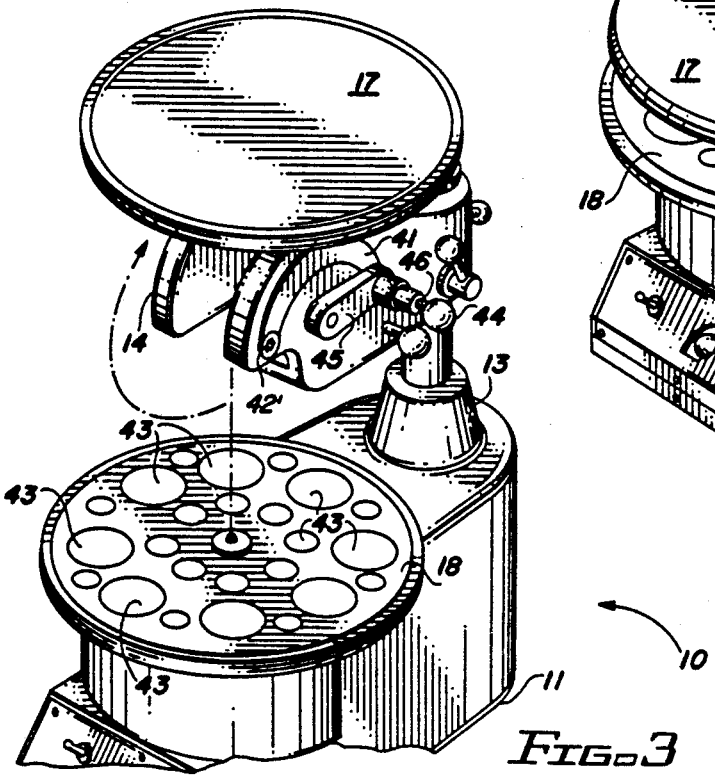
FIG. 3

PLANETARY LAP

BACKGROUND OF THE INVENTION

This invention relates to lapping machines and more particularly to a machine for automatically lapping the opposite faces of workpieces fitted in carriers which are placed between upper and lower surfaces of a pair of lap plates. The carriers may be given a compound motion along a continuously changing path.

DESCRIPTION OF THE PRIOR ART

Lapping machines are well known in the art, however, none of the known machines employ a floating top lap plate which is controllable to render it free wheeling, lockable in place with variable pressure being applicable thereto when in contact with an associated lower lap plate, and rotatable to one of a number of positions for ease in inspecting the work in the carrier, removing it from the carriers and inspecting the grinding surfaces of the lap plates.

U.S. Pat. No. 1,634,745 discloses a lapping machine and method of truing the lapping elements wherein the parts of the machine are so arranged and the work so moved that every portion of the lapping surface is covered by the work at some time during its movement whereby the formation of lines of the work is prevented and uniform wear of the lapping elements insured.

U.S. Pat. No. 2,618,911 discloses a lapping machine for automatically lapping the opposite faces of relatively large diameter, relatively thin workpieces to a predetermined size and finish.

U.S. Pat. No. 4,205,489 discloses an apparatus for finishing workpieces on surface lapping machines wherein the apparatus changes the rotational speed of the workpiece holder axle relative to the axle of a drive shaft, the tangential acceleration of this movement, and the pressure between the surfaces of the workpieces and the lapping tools.

U.S. Pat. No. 4,593,495 discloses a polishing machine wherein the upper and lower surfaces are rotated relative to each other. A carrier for the workpieces is fitting therebetween and is engaged with both a sun gear and an internal ring gear within the same plane for rotation thereof.

SUMMARY OF THE INVENTION

In accordance with the invention claimed, a simple and thoroughly practical lapping machine is disclosed wherein one lap plate is adjustable for a plurality of movements relative to another lap plate.

Another object of this invention is to angularly move a top lap plate relative to a bottom or lower lap plate of said lapping machine to aid in inspecting, loading and unloading the workpieces of an associated carrier plate.

A further object of this invention is to provide a ne and improved lapping machine in which a top lap plate is floating and controllable to assume a free wheeling and/or locked position with variable pressure being applicable thereto.

A still further object of this invention is to provide a lapping machine wherein the workpieces are lapped flatter than the lap plates.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which:

FIG. 1 is a perspective view of a lapping machine embodying the invention;

FIG. 2 is a view of FIG. 1 with the upper lap plate vertically elevated;

FIG. 3 is a view of FIG. 1 with the upper lap plate rotated 180 degrees from the position shown in FIGS. 1 and 2;

DESCRIPTION OF THE PREFERRED EMBODIMENT

Figure 4:
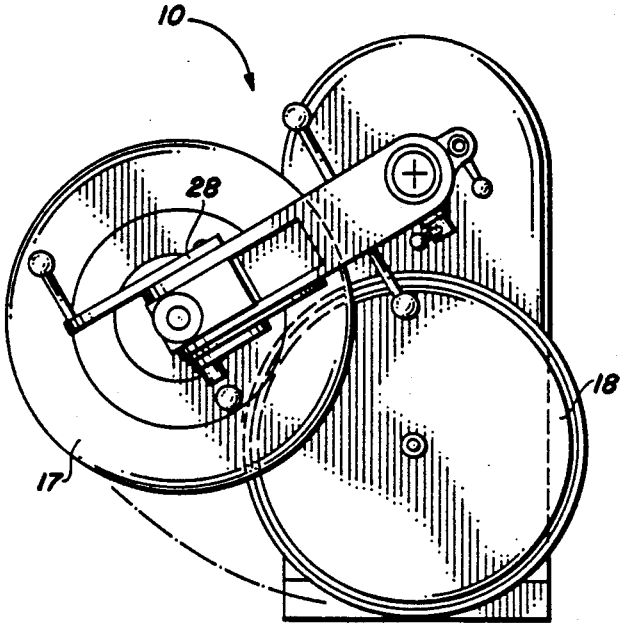
FIG. 4 is a top view of FIG. 2 with the top lap plate angularly rotated relative to its position shown in FIG. 2.
Figure 7:
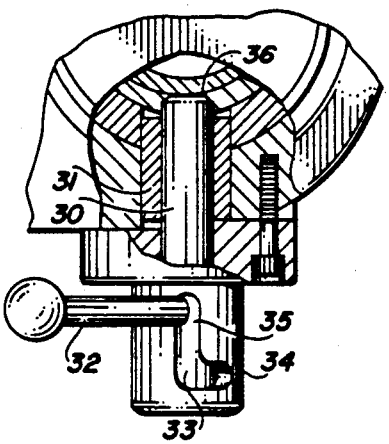
FIG. 7 is an enlargement of the circled area 7 of FIG. 5.
Figure 5:
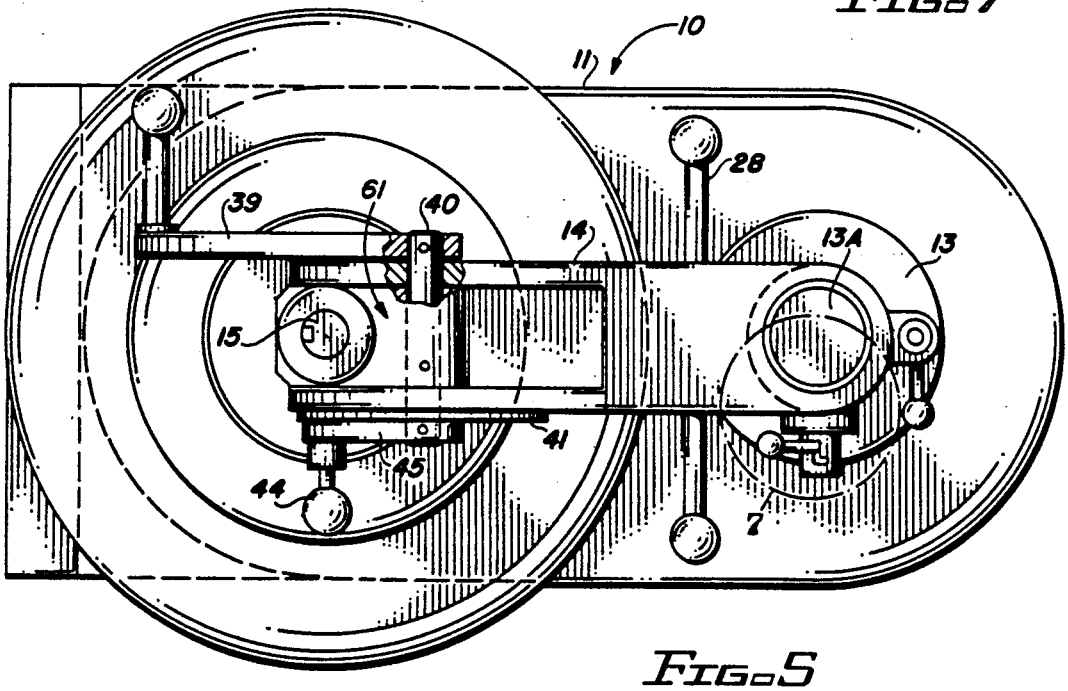
FIG. 5 is a top view of FIG. 1.
Figure 6:
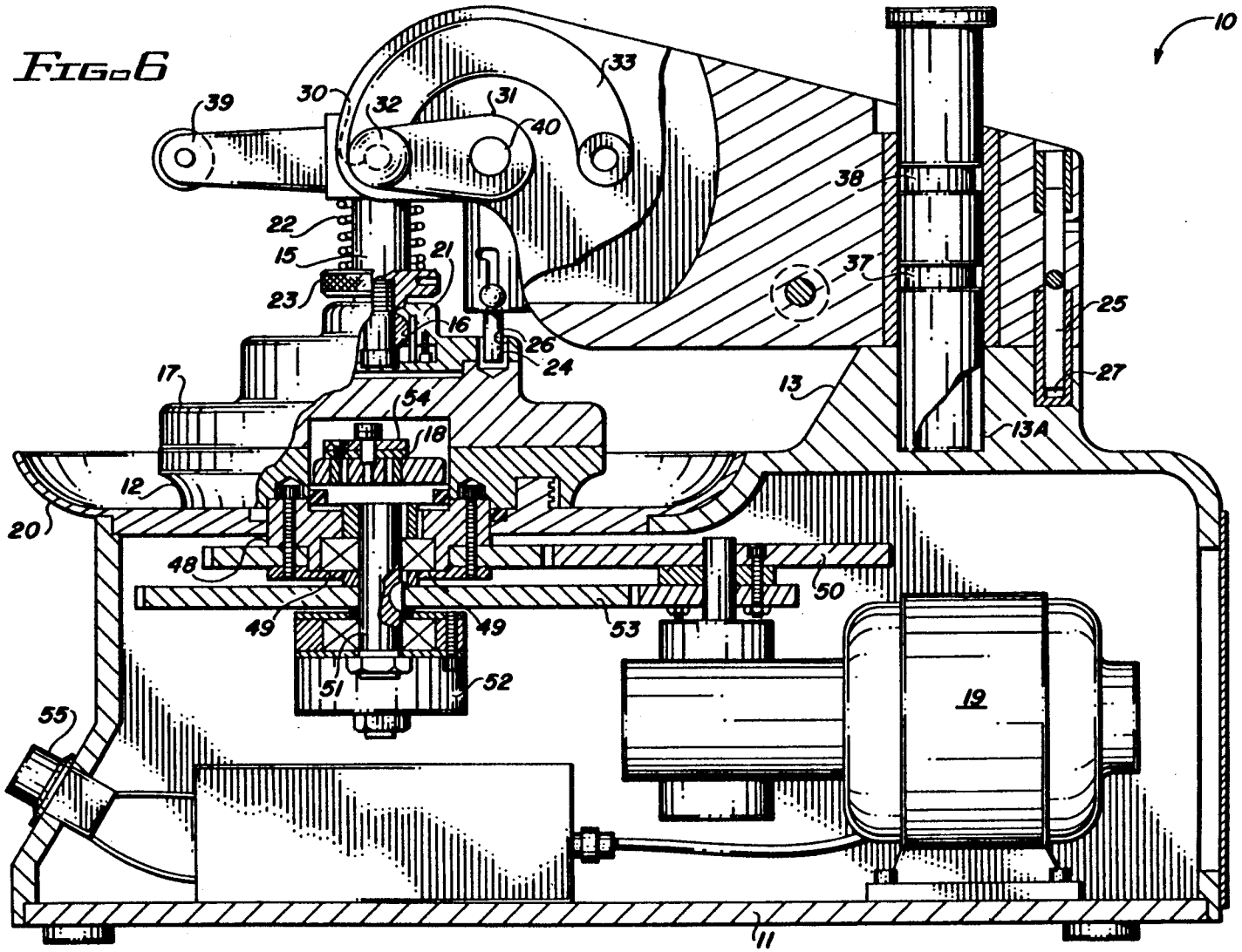
FIG. 6 is a cross sectional view of FIG. 1.

Referring more particularly to the drawings by characters of reference, FIGS. 1–7 disclose a lapping machine 10 comprising a frame 11 which rotatably supports a lower lapping wheel or lap plate 12. The top of the frame is provided with an upwardly extending boss 13 containing a fixed column or post 13A around which a U-shaped arm 14 extends outwardly therefrom supporting between its legs a vertically positioned spindle 15 as shown in FIGS. 5 and 6. Spindle 15 is provided at its lower end with a ball 16 threadedly attached thereto forming a part of a universal joint which ball supports an upper lapping wheel or lap plate 17. Upper lap plate 17 is in axial alignment with lower lap plate 12. The lap plates are each provided with plane operative opposed, juxtapositioned faces for simultaneously lapping the opposite sides of a plurality of workpieces.

Power for rotating the lower lap plate 12 and an associated carrier 18 arranged between the lap plates may be obtained from any suitable source such as, for example, an electric gear motor 19 mounted on and within frame 11.

While the upper and lower lap plates may be otherwise mounted for carrying out the functions herein described, for purposes of illustration the upper or top lap plate 17 is vertically movable toward and away from the lower lap plate 12 in a controllable arrangement so as to assume a free wheeling and/or locked position relative to the lower plate 12. The lower lap plate 12 is positioned within an annular disk shaped bowl member 20 which in turn is suitably mounted on frame 11 of the machine.

In order to permit alignment of the juxtapositioned faces of the upper and lower lap plates, the upper lap plate is mounted on a universal joint which comprises ball 16 threaded to the lower end of spindle 15, as shown in FIG. 6, around which is formed a socket 21 of the joint.

The upper vertically movable lap plate 17 carried by spindle 15 is urged toward the lower lap plate 12 by a coil spring 22 which surrounds spindle 15 and bears at its upper end against frame 11 and at its other end against adjustment nut 23 which is threadedly mounted on spindle 15. This arrangement makes it possible to vary the pressure of the upper lap plate against the lower lap plate. By placing coil spring 22 and adjustment nut 23 on the top of pivot block 61, the lapping pressure may be reduced to less than the weight of the plate assembly. This is an important feature when lapping fragile pieces.

In order to control the movement of spindle 15, a pair of anti-rotational pins 24 and 25 are provided with pin 24 being movably mounted axially in a hole 16 formed in the top surface of upper lap plate 17 and pin 28 movably mounted axially in a hole 27 formed in the top surface of boss 13.

Pin 24 is in the down position (as shown in FIG. 6) except when lapping the upper and lower lap plates together for dressing them flat.

Pin 25 remains in the down position shown in FIG. 6 except when swinging the upper lap plate 17 off center with reference to lower lap plate 12 to examine the work parts and while lapping the upper and lower lap plates together to dress them flat.

Thus, anti-rotational pins 24 and 25 permit vertical movement of upper lap plate 17 but prevent rotational movement thereof when the upper and lower lap plates are in lapping and/or polishing positions.

As shown in FIG. 5, arm 14 is journaled around column 13A for vertical movement therealong or axial movement therearound. The vertical movement of arm 14 along column 13A may occur by lifting the head of the machine, namely arm 14 and upper lap plate 17 away from the lower lap plate 12 by a handle 28 which extends through arm 14 and laterally therefrom.

In order to lock and/or restrain arm 14 and the associated upper lap plate 17 in either the upper position along column 13A or the lower position, a pin mechanism 29 is provided. This mechanism comprises a pin 30 that is slideably movable through a bushing 31 in arm 14 and into and out of engagement with column 13A. Pin 30 is movable by a crank handle 32 which is movable along a contoured slot 33 in a collar 34 formed axially over end 35 of pin 30. The other end 36 of pin 30 moves into and out of circular grooves 37 and 38 formed laterally around the circumference of column 13A as shown in FIG. 5.

Thus, arm 14 may be moved vertically along column 13A and maintained in either one of the two positions identified by grooves 37 and 38 and rotated freely about column 13A.

In order to rotate arm 14 about column 13A, a crank arm 39 is provided which extends laterally outwardly of arm 14 as shown in FIG. 5.

With arm 14 elevated as heretofore explained, upper lap plate 17 may be rotated about arm 14 to the position shown in FIG. 3. To accomplish this function, spindle 15 and the associated upper lap plate 17 are rotatable around a pin 40 which is journaled to extend between the legs 14A and 14B of the U-shaped arm 14. As shown in the drawings the leg 14B of arm 14 is provided with an arcuate shaped wear plate 41 which is provided with bores 42 and 43 one at each end of the arcuate configuration. A spring biased latching mechanism 44 is pivotally mounted on leg 14B of arm 14 the crank arm 45 of which is provided at its free end with a pivotally mounted latch pin 46, which is positioned to be released in bores 42 and 43 to lock the lower lap plate in 180 degree relative positions. With the latch pin 46 withdrawn from one of bores 42 and 43, spindle 15 and the associated upper lap plate may be rotated 180 degrees around the end of arm 14. With pin 46 released into one of bores 42 and 42', the spindle and associated lap plate will be physically locked in the associated position. It should be noted that the 180 degree arcuate movement of the spindle and upper lap plate is caused by the latching mechanism 44 transversing the wear plate 41 from one end thereof to the other.

The lower lap plate 12 is fixedly attached to a collar 48 which is rotatably mounted on frame 11 within bearings 49. Collar 48, in turn, is rotated by motor 19 through a suitable gear, O-ring or belt drive 50, as shown in FIG. 6.

Carrier 18 mounted between the upper and lower lap plates is fixedly secured on the end of a vertically positioned shaft 51 which extends at its upper end through an axially aligned hole or aperture in the lower lap plate 12. Shaft 51 is journaled within collar 48 and a frame projection 52 and is driven by motor 19 at a different speed and, in some applications, in a reverse direction in relationship to lap plate 17 through suitable gears, 0-ring or belt drive 53.

As shown in FIG. 6, carrier 18 is attached to the top of the vertically positioned shaft 51 by a suitable carrier mount 54 for rotation therewith.

Suitable electrical controls 55 are mounted on the front of the lapping machine for controlling the actuation and timing of motor 18, indicating amount of stock removed, shows power loading, "on/off" light, etc.

Each of the lap plates may be made of a suitable material, well known in this art, and have, for example, a grinding surface formed of a stone of suitable bonded abrasive grains such as is employed in grinding wheels, or material such as cast iron impregnated with diamond compound.

In operation, the carrier of the lapping or polishing machine is loaded or unloaded when the upper lap plate is moved upwardly by the operator raising handle 28. In a loading process, plural workpieces (not shown) to be processed are fitted into through bores or shaped cutouts 43 configured to the workpiece of the carrier 18. The carrier when loaded is already positioned between the lapping plates and secured to the top of shaft 51 by carrier mount 54 as heretofore explained. The upper lap plate 17 is then lowered to its predetermined lower floating position by the user using handle 28. The processing pressure is preset to a predetermined value by the adjustment of nut 23 by the operator. Thus, the workpieces are sandwiched between the upper and lower juxtapositioned abrasive surfaces of lapping plates 12 and 17 under a predetermined pressure.

The gear and/or belt drives 50 and 53 are rotated by electric motor 19 to rotate the carrier and lower lap plate at different speeds thereby enabling the workpieces to be ground and/or polished.

In accordance with the claimed invention, lapping machine 10 employs a novel floating top lap plate 17 which may be moved vertically upward a predetermined distance by head lifting handles after pin 25 has been raised out of its associated bore 27 in frame 11, and then rotated laterally in a horizontal plane as shown in FIG. 4, to expose carrier 18 for removal and/or loading of another carrier in the machine.

Further vertical upward movement of upper lap plate 17 by crank arm 39 causes a rotation of spindle 15 and upper lap plate 17 in a plane substantially parallel to the longitudinal axis of arm 14.

In view of the controlled movement of the upper lap plate with relationship to the carrier plate and the lower lap plate, the user may quickly vary the pressure of the upper lap plate against the lower lap plates, move the upper lap plate away from and laterally to the lower lap plate for exposing the carrier plate, and rotate the upper lap plate 180 degrees to expose its grinding surface for maintenance of both lap plates.

Figure 8:
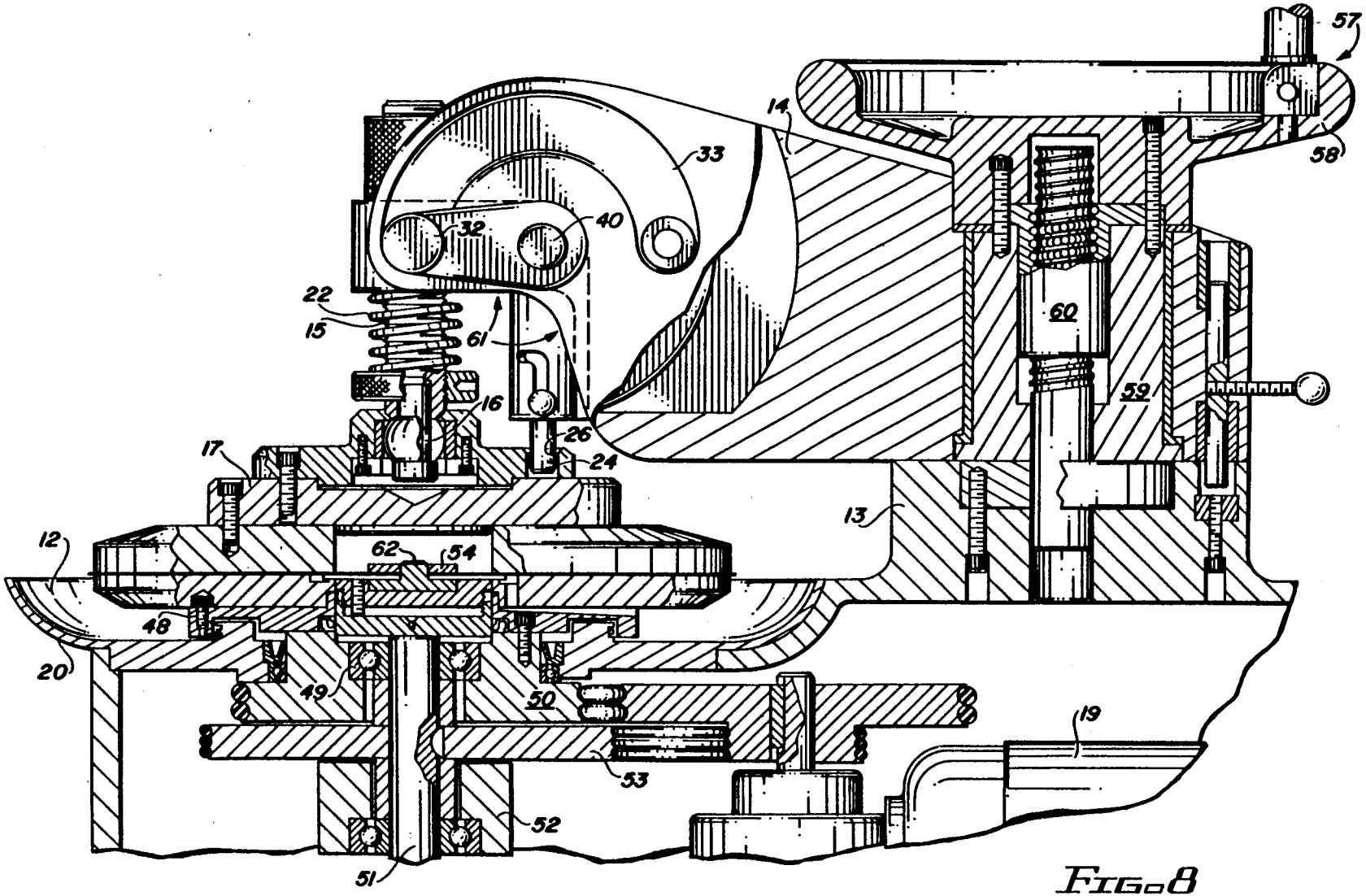
FIG. 8 is a cross sectional view of a modification of the lapping machine shown in FIGS. 1–7.

FIG. 8 discloses a modification of the lapping machine 10 shown in FIGS. 1–7 wherein like parts are given the same reference characters.

As shown, carrier 18 is positioned between the lapping surfaces of lower and upper lap plates 12 and 17 and secured to the top of shaft 51 in axial alignment therewith. Shaft 51 is rotated by gear and/or belt drive 53 to rotate the carrier at a given speed.

The lower lap 12 is driven at a different speed than the carrier by gear and/or belt drive 50.

FIG. 8 further differs from the lapping machine shown in FIGS. 1–7 by disclosing a hand wheel mechanism 57 which is used to lift arm 14, i.e., the head of the machine including the upper lap plate 17 away from the lower lap plate 12. The hand wheel mechanism 57 comprises a hand wheel 58 that is mounted on the end of a column 59 which column is threaded movable within a cylinder 60. Upon rotation of hand wheel 58 in one direction arm 14 and the associated upper lap plate 17 of the lapping machine may be moved away from the lower lap plate. Reverse rotation of the hand wheel will position the upper lap plate juxtapositioned to the lower lap plate 12.

Upon raising the anti-rotational pin 25 as previously discussed, arm 14 and associated upper lap plate 17 may be rotated relative to the lower lap plate by the hand wheel 58.

It should be noted, as shown in FIG. 8, that the eccentricity of the carrier plate 12 to the lap plate 17 may be adjusted by loosening carrier mount 54 and then rotating carrier support 62 and carrier 18 relative to lap plate 17 and then retightening carrier mount 54.

Although but two embodiments of the invention have been illustrated and described, it will be apparent to those skilled in the art that various changes and modifications may be made therein without departing from the spirit of the invention or from the scope of the appended claims.

What is claimed is:

1. A lapping machine for abrading the surfaces of at least one workpiece comprising:

a frame, a post vertically mounted on said frame an arm extending laterally from said post, a spindle extending substantially vertically from said arm, a first lap plate mounted on the end of said spindle, a second lap plate rotatably mounted on said frame adjacent to and in axial alignment with said first lap plate, a carrier for at least one workpiece axially mounted on said frame between said first and second lap plates, an electric motor means for rotating said carrier and said second lap plate at different speeds, a first means mounted on said spindle for selectively adjusting the pressure of said first lap plate against said carrier and said second lap plate, and a second means mounted on said arm for selectively rotating said spindle and said first lap plate from adjacent said carrier and said second lap plate through an arcuate path of approximately 180 degrees in a plane parallel to said arm for exposing the lapping surface of said first lap plate, and a third means vertically movable on said frame for selectively locking said arm in one position to prevent rotation thereof laterally of the axis of said spindle when said first lap plate is juxtapositioned to said second lap plate and in a second position when moved away from said second lap plate for unlocking said arm to permit said lateral rotation of said arm.

2. A lapping machine for abrading the surfaces of at least one workpiece comprising:

a frame, a post vertically mounted on said frame, an arm extending laterally from said post, a spindle extending substantially vertically from said arm;

a first lap plate mounted on the end of said spindle, a second lap plate rotatably mounted on said frame adjacent to and in axial alignment with said first lap plate, said second lap plate having a hole extending axially therethrough, a carrier for at least one workpiece axially mounted between said first and second lap plates, a driving shaft rotatably mounted on said frame in axial alignment with said first and second lap plates with one end extending through said hole in said second lap plate, a first means for detachably mounting said carrier on said one end of said driving shaft, a second means for rotating said driving shaft and second lap plate at directions relative to each other, a third means mounted on said spindle for selectively adjusting the pressure of said first lap plate against said carrier and said second lap plate, a fourth means vertically movable on said frame for selectively locking said arm in one position to prevent rotation thereof laterally of the axis of said spindle and in a second position unlocking said arm to permit said lateral rotation of said arm, said fourth means comprising a pair of pins mounted on said arm with one selectively movable into a bore in said upper lap plate and the other selectively movable into a bore in said frame, and a fifth means mounted on said arm for selectively rotating said spindle and said first lap plate from adjacent said second lap plate through an arcuate path of approximately 180 degrees in a plane parallel to said arm for exposing the lapping surface of said first lap plate and lapping each plate flat in relation to the other.

3. The lapping machine set forth in claim 2 wherein:

said third means comprises a coil spring mounted around said spindle and baring at one end against said frame and at the other end against a spring pressure adjustment means, and said adjusting means comprising a nut threadedly mounted on said spindle and bearing against the other end of said coil spring.

4. The lapping machine set forth in claim 2 wherein:

said fifth means comprises a pin rotatably mounted on said arm and having a lever arm extending laterally therefrom, a tapered spring loaded plunger mounted on said lever arm and connected to said spindle, and an arcuate wear plate formed on said arm and extending along its length, said wear plate defining a pair of tapered bores one at each end thereof, said lever arm being positionable in one of said tapered bores to rigidize said first lap plate at each end of the wear plate.

5. The lapping machine set forth in claim 2 wherein: said first lap plate is mounted on the end of said spindle by a ball and socket connection.

* * * * *

UNITED STATES PATENT OFFICE

CERTIFICATE OF CORRECTION

Patent No. 5,016,399 Dated May 21, 1991

Inventor(s) Paul Vinson

It is certified that error appears in the above-identified patent and that said Letters Patent is hereby corrected as shown below:

Claim 1, line 4, after "frame", insert ---,---.

Claim 2, line 7, after "arm", delete ";" and substitute ---,---.

Claim 3, line 3, after "and", delete "baring" and substitute ---bearing---.

Signed and Sealed this

Eighth Day of September, 1992

*Attest:*

DOUGLAS B. COMER

*Attesting Officer*

*Acting Commissioner of Patents and Trademarks*